United States Patent [19]

Isaacson et al.

[11] 4,331,751

[45] May 25, 1982

[54] ELECTRICALLY PHOTOSENSITIVE MATERIALS AND ELEMENTS FOR PHOTOELECTROPHORETIC IMAGING PROCESSES

[75] Inventors: Henry V. Isaacson, Webster; Beth G. Wright; Hal E. Wright, both of Rochester, all of N.Y.

[73] Assignee: Eastman Kodak Company, Rochester, N.Y.

[21] Appl. No.: 207,114

[22] Filed: Nov. 17, 1980

[51] Int. Cl.[3] ..... G03G 17/04

[52] U.S. Cl. ..... 430/18; 430/37; 528/290; 528/292

[58] Field of Search ..... 430/37, 18; 528/292, 528/290

[56] References Cited

U.S. PATENT DOCUMENTS 4,076,527 2/1978 Nealy ..... 430/37

4,092,162 5/1978 Wright et al. ..... 430/57

*Primary Examiner*—Roland E. Martin, Jr.

*Attorney, Agent, or Firm*—Torger N. Dahl

[57] ABSTRACT

Electrically photosensitive materials and elements comprising an electrically photosensitive polymeric compound of the structure:

I wherein:

$R_1$ and $R_3$, which are the same or different, represent a substituted or unsubstituted alkyl group having from 1 to 18 carbon atoms or a substituted or unsubstituted aryl group;

$R_2$ and $R_4$, which are the same or different, represent a substituted or unsubstituted alkylene group having from 1 to 10 carbon atoms or a substituted or unsubstituted arylene group;

$R_5$ and $R_6$, which are the same or different, represent hydrogen or an electron withdrawing group;

$R_7$ and $R_8$, which are always different, represent oxy, imino, thio, carbonyloxy, oxycarbonyl, iminocarbonyl, carbonyldioxy, ureylene, carbonyloxycarbonyl, sulfonyl, iminosulfonyl, iminocarbonyloxy, piperidine-1,4-diyl and 1-carbonylpiperidine-1,4-diyl;

Ar is an unsubstituted or a substituted arylene group wherein said substituent is an electron donating group or an electron withdrawing group;

a and d are 0 or 1;

b and c are whole numbers of from 1 to 25; and n is a whole number having a value of at least 2.

15 Claims, 1 Drawing Figure

ELECTRICALLY PHOTOSENSITIVE MATERIALS AND ELEMENTS FOR PHOTOELECTROPHORETIC IMAGING PROCESSES

FIELD OF THE INVENTION

This invention relates to photoelectrophoretic imaging processes and, to certain electrically photosensitive layers, elements and materials which are useful in such processes.

BACKGROUND OF THE INVENTION

Extensive descriptions of photoelectrophoretic imaging processes exist in the patent and other technical literature. Descriptions of photoelectrophoretic imaging processes are contained in U.S. Pat. No. 2,758,939 by Sugarman issued Aug. 14, 1956; 2,940,847, 3,100,426, 3,140,175 and 3,143,508, all by Kaprelian; 3,384,565, 3,384,488 and 3,615,558, all by Tulagin et al; 3,384,566 by Clark; 3,383,993 by Yeh; and U.S. Pat. No. 3,976,485 by Groner.

In each of the foregoing photoelectrophoretic imaging processes an imaging layer comprising electrically photosensitive material is subjected to the influence of an electric field and exposed to an image pattern of electromagnetic radiation to which the electrically photosensitive material is sensitive. The electrically photosensitive material is caused to migrate imagewise in the layer to form a record of the imaging electromagnetic radiation.

Regardless of the particular photoelectrophoretic imaging process employed, it is apparent that an essential component of any such process is the electrically photosensitive material. To obtain an easy-to-read visible image it is desirable that the electrically photosensitive material be colored.

Generally useful electrically photosensitive compounds for photoelectrophoretic imaging have been selected from known classes of photoconductive compounds which have been employed in conventional photoconductive elements, e.g., photoconductive plates, drums, or webs used in electrophotographic copier devices. For example, both Sugarman and Kaprelian in the above-referenced patents state that electrically photosensitive materials useful in photoelectrophoretic imaging processes may be selected from known classes of photoconductive materials. Also, the phthalocyanine pigments described as useful electrically photosensitive material for photoelectrophoretic imaging processes in U.S. Pat. No. 3,615,558 by Tulagin et al have long been known to exhibit useful photoconductive properties.

However, many of the photoconductive materials chosen for use in photoelectrophoretic imaging processes have been inadequate in various aspects such as low electrical photosensitivity and poor color reproduction. Accordingly, there exists a continuing effort to find materials which possess both useful levels of electrical photosensitivity and which exhibit good colorant properties.

SUMMARY OF THE INVENTION

The present invention provides electrically photosensitive materials which are useful in photoelectrophoretic imaging layers, elements and processes. In general these materials possess both useful levels of electrical photosensitivity and good colorant properties. The materials comprise electrically photosensitive polymeric compounds having the general structure:

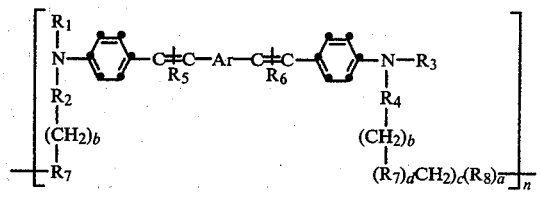

I wherein:

$R_1$ and $R_3$, which are the same or different, represent a substituted or unsubstituted alkyl group having from 1 to 18 carbon atoms or a substituted or unsubstituted aryl group;

$R_2$ and $R_4$, which are the same or different, represent a substituted or unsubstituted alkylene group having from 1 to 10 carbon atoms or a substituted or unsubstituted arylene group;

$R_5$ and $R_6$, which are the same or different, represent hydrogen or an electron withdrawing group;

$R_7$ and $R_8$, which are always different, represent oxy, imino, thio, carbonyloxy, oxycarbonyl, iminocarbonyl, carbonyldioxy, ureylene, carbonyloxycarbonyl, sulfonyl, iminosulfonyl, iminocarbonyloxy, piperidine-1,4-diyl and 1-carbonylpiperidine-1,4-diyl;

Ar is an unsubstituted or a substituted arylene group wherein said substituent is an electron donating group or an electron withdrawing group;

a and d are 0 or 1;

b and c are whole numbers of from 1 to 25; and n is a whole number having a value of at least 2.

In Formula I the configurations $$-C\underset{R_5}{\ddot{=}}C \text{ and } -C\underset{R_6}{\ddot{=}}C$$

mean that the $R_5$ or $R_6$ substituents replace a hydrogen on only one of the adjacent carbon atoms.

If the electrically photosensitive layer is solid it can be at least partially liquefied before, during or after exposure and application of the electric field to facilitate migration of said electrically photosensitive material in said layer. Means for achieving at least partial liquefication will be described hereinafter.

The electrically photosensitive material of this invention comprises at least one electrically photosensitive polymeric compound according to Formula I. In addition, the electrically photosensitive material of this invention must also include at least one of the following addenda: liquid or liquefiable electrically insulating carrier, a charge control agent, chemical or spectral sensitizers, and additional colorants (dyes or pigments) which may or may not be electrically photosensitive. Other addenda necessary to change or enhance the properties of the material may also be included. The electrically photosensitive material of this invention may be in the form of a suspension, dispersion, or liquid or liquefiable layers.

The present invention also provides a photoelectrophoretic image recording method comprising the steps of:

(a) subjecting an imaging element comprising a layer of an electrically photosensitive imaging material comprising an electrically photosensitive polymeric compound according to Formula I to an electric field;

(b) exposing said element to an image pattern of electromagnetic radiation to which said electrically photosensitive layer is photosensitive, to form a record of the image pattern of electromagnetic radiation in said layer.

If the layer is solid it can be at least partially liquefied before, during or after exposure and application of the electric field to facilitate migration of said electrically photosensitive material in said layer. Means for achieving at least partial liquefication will be described hereinafter.

DESCRIPTION OF THE PREFERRED EMBODIMENTS

Figure 1:
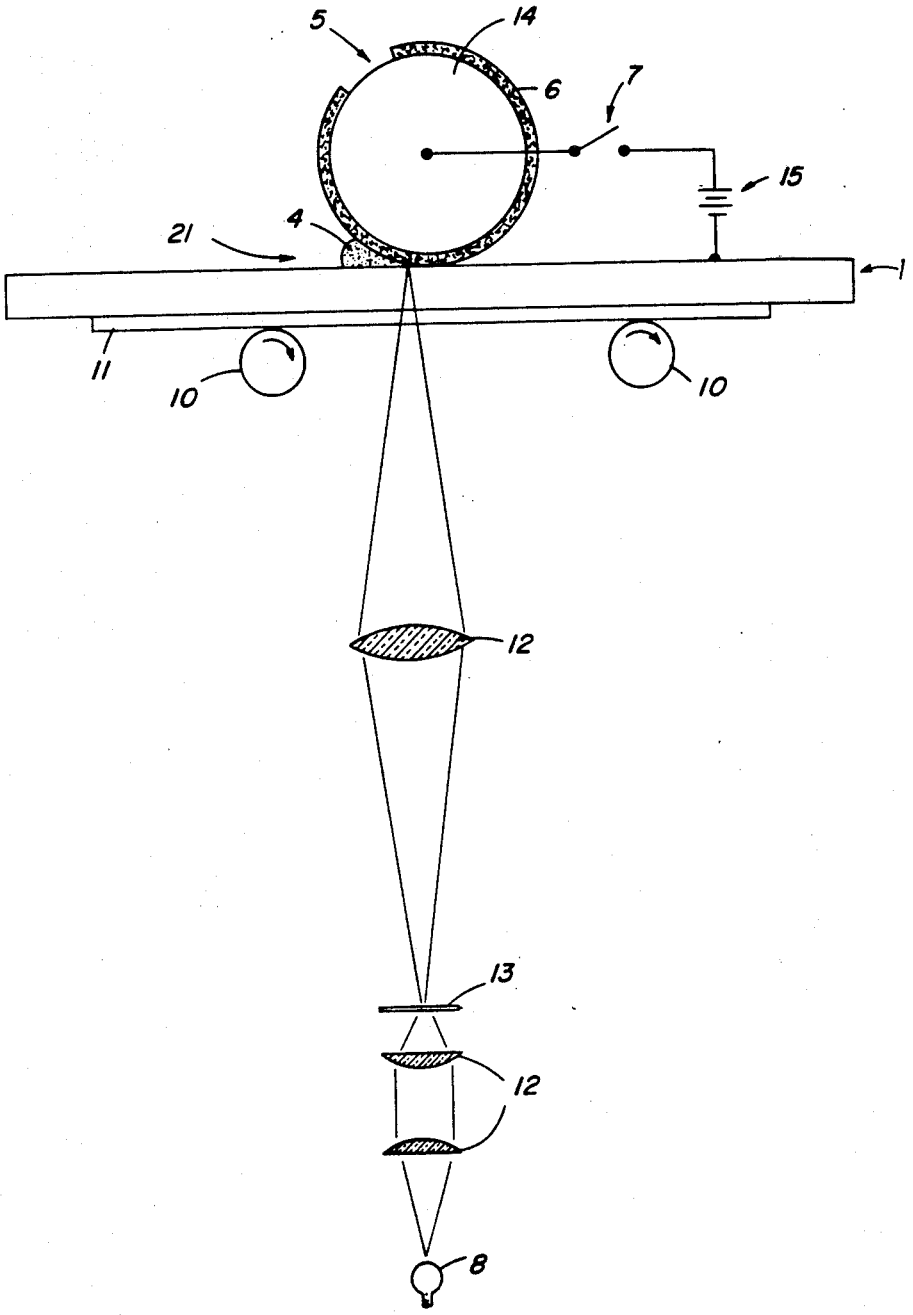
FIG. 1 represents diagrammatically a typical imaging apparatus for carrying out a photoelectrophoretic imaging process of the invention.

A preferred embodiment of the present invention provides electrically photosensitive materials comprising electrically photosensitive polymeric compounds having the structure of Formula I wherein:

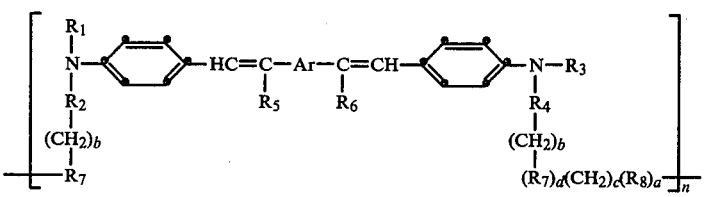

II $R_1$ and $R_3$, which are the same or different, represent a substituted or unsubstituted alkyl group having from 1 to 18 carbon atoms or a substituted or unsubstituted aryl group;

$R_2$ and $R_4$, which are the same or different, represent an alkylene group having from 1 to 10 carbon atoms or a substituted or unsubstituted arylene group;

$R_5$ and $R_6$, which are the same or different, represent hydrogen or an electron withdrawing group selected from the group consisting of —CN, —$CF_3$, —$NO_2$, —$CO_2R_9$, —$SO_2F$ wherein $R_9$ is an alkyl group having from 1 to 12 carbon atoms;

$R_7$ and $R_8$, which are always different, represent oxy, imino, thio, oxycarbonyl, iminocarbonyl, carbonyldioxy, ureylene, carbonyloxycarbonyl, sulfonyl, iminosulfonyl, iminocarbonyloxy, piperidine-1,4-diyl and 1-carbonylpiperidine-1,4-diyl;

Ar represents a substituted or unsubstituted phenylene, naphthylene or anthrylene wherein said substituent is selected from the group consisting of hydrogen, —CN, —$CO_2R_9$, —$OR_9$, —$CF_3$, —$NO_2$, —Cl, —$SR_9$ and —$R_9$;

a and d are 0 to 1;

b and c are whole numbers of from 1 to 25; and n is a whole number having a value of from about 2 to about 150.

DETAILED DESCRIPTION OF THE INVENTION

In general, the electrically photosensitive polymeric compounds of Formula I exhibit a maximum absorption wavelength, λmax, within the range of from about 400 to about 550 nm. A variety of different materials within the class defined by Formula I have been tested and found to exhibit useful levels of electrical photosensitivity in photoelectrophoretic imaging processes.

A partial listing of representative such polymeric compounds is included herein in Table I. Polymeric compounds included in Formula I may be prepared according to the procedures set out in U.S. Pat. No. 4,092,162, wherein the Formula I materials are described as sensitizers for certain multilayer photoconductive compositions.

TABLE I
Polymeric Compound:
1.
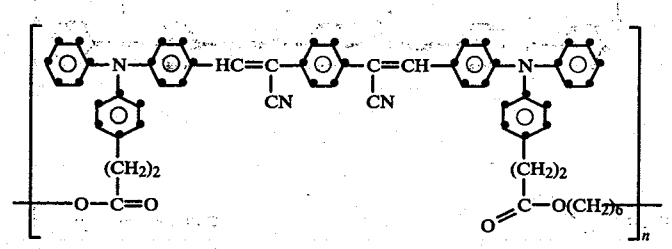
2.
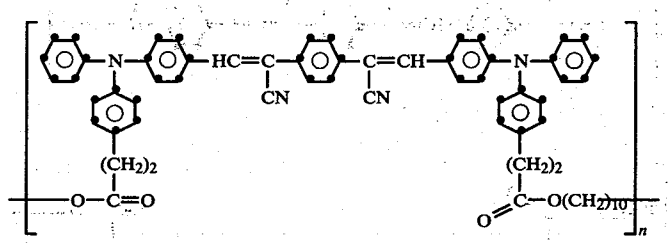
3.
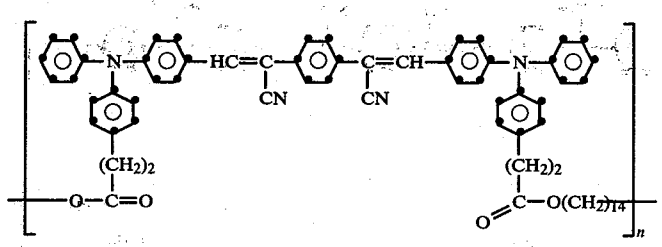
4.
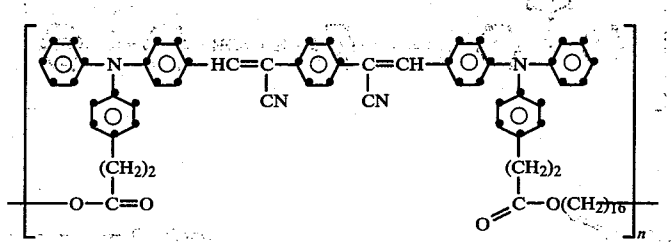
5.
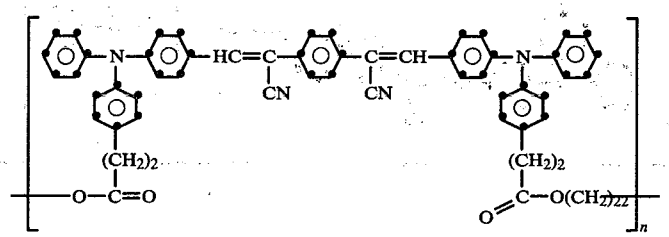
6.
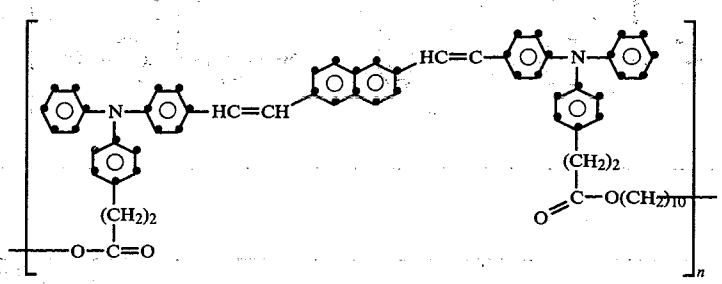

TABLE I-continued
| Polymeric Compound: | |
|---|---|
| 7. | 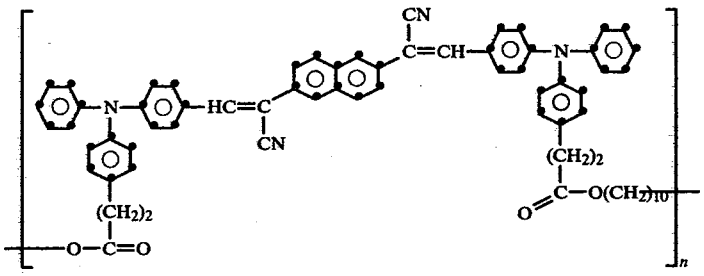 |
| 8. | 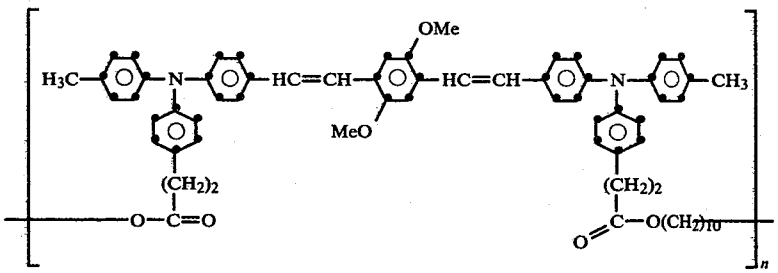 |
| 9. | 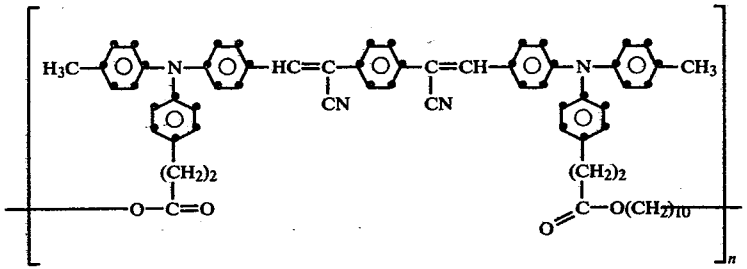 |
| 10 | 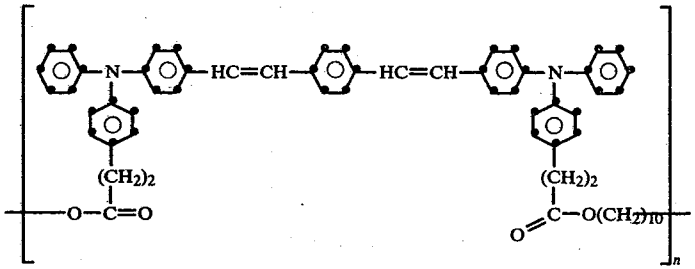 |
| 11. | 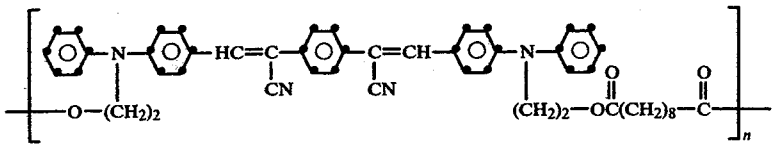 |
| 12. | 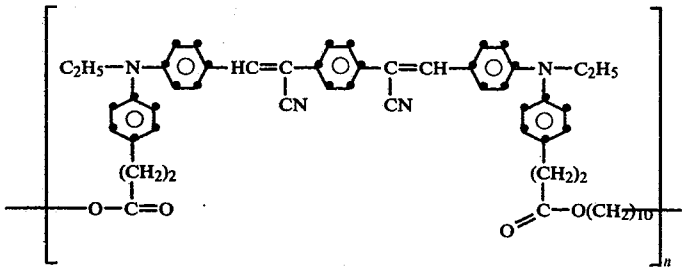 |

TABLE I-continued
Polymeric Compound:
13.
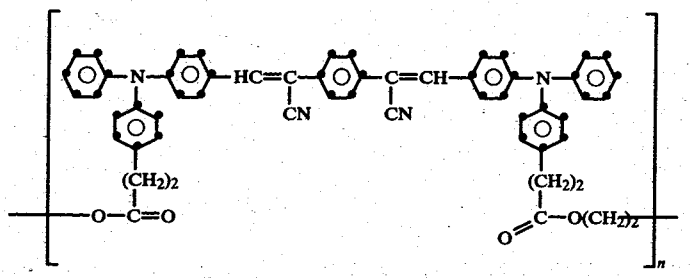
14.
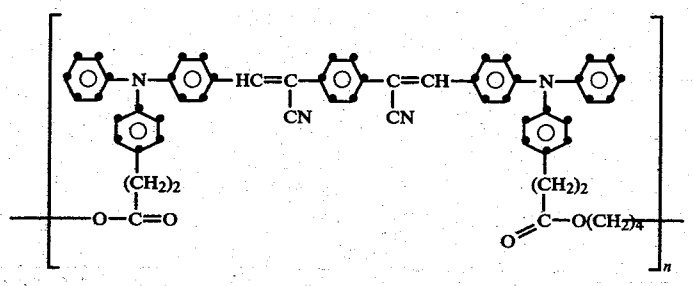
15.
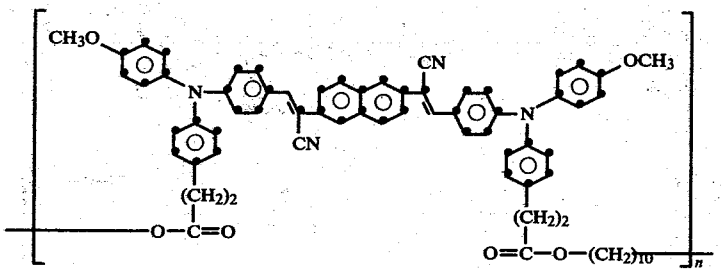
16.
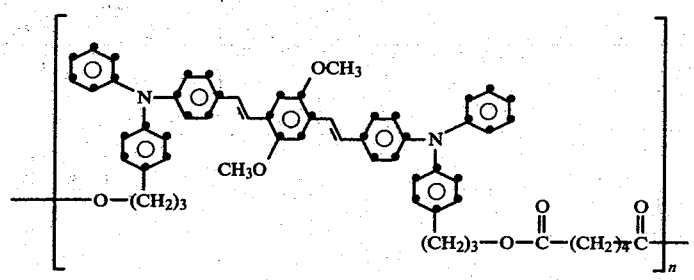
17.
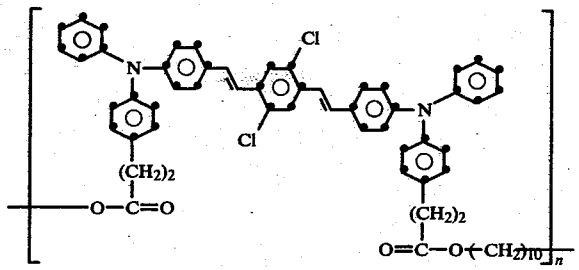
18.
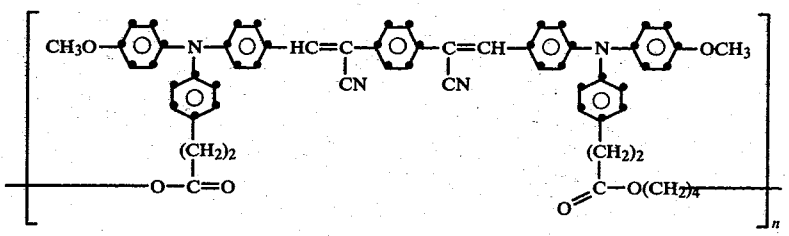
19.
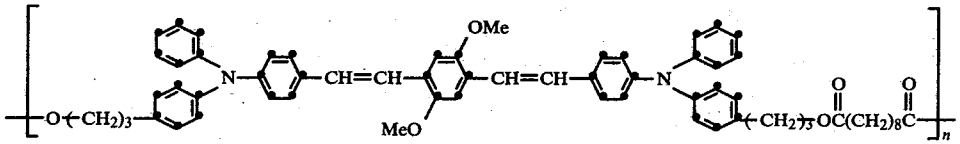

TABLE I-continued
| Polymeric Compound: | |
|---|---|
| 20. | 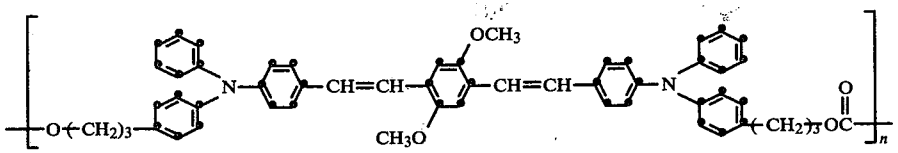 |
| 21. | 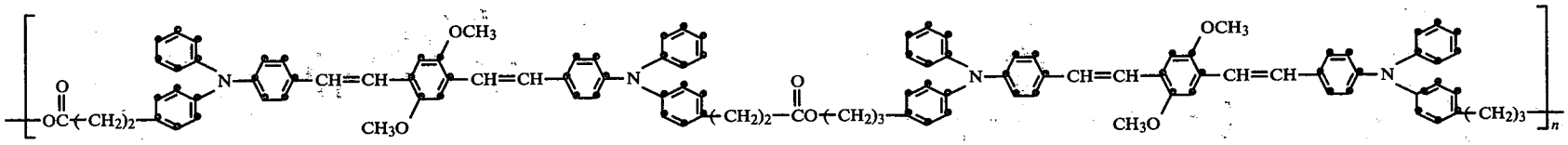 |
| 22. | 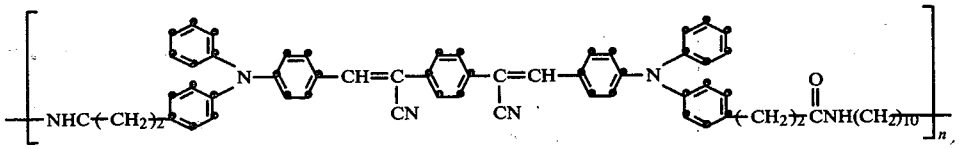 |
| 23. | 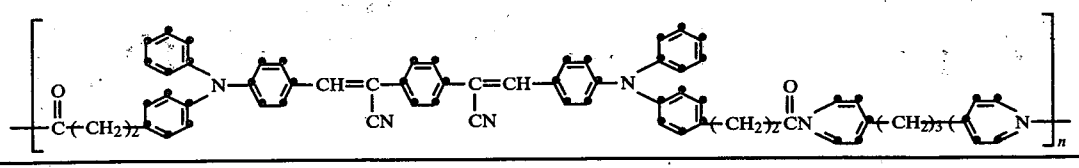 |

The electrically photosensitive polymeric compounds of Formula I are useful in all electrically photosensitive materials, imaging layers and photoelectrophoretic imaging processes which require the combined action of an electric field and exposure to an image pattern of electromagnetic radiation to obtain an image. The Formula I materials are also useful in imaging processes such as those described in U.S. Pat. Nos. 3,520,681; 3,770,430; 3,795,195; 4,013,462; 3,707,368; 3,692,576 and 3,756,812, all relating to manifold imaging or photoelectrosology.

In one photoelectrophoretic imaging process an element comprising a conductive support, or a support having a conductive layer, in electrical contact with a liquefied or partially liquefied imaging layer of electrically photosensitive material is imaged in the following manner. An electrostatic charge pattern is formed on the imaging layer, for example, by uniformly electrostatically charging the layer and then exposing it to an image pattern of activating electromagnetic radiation. The electrically photosensitive particles in the imaging layer which have been exposed to radiation migrate through the imaging layer leaving an undeveloped image record of the charge pattern on the conductive substrate. This image is developed by submerging the element in a solvent which removes or dissolves the exposed, or the unexposed portions of the imaging layer.

In another such process, a liquid or at least a partially liquid electrically photosensitive imaging layer is positioned between two spaced electrodes. While so positioned between two spaced electrodes, the imaging layer is subjected to an electric field and exposed to an image pattern of activating radiation. As a consequence, the charge-bearing, electrically photosensitive particles in the imaging layer migrate to one or the other of the electrode surfaces to form on at least one of the electrodes an image record representing a positive-sense or negative-sense image of the original image pattern. The image record is developed by separation of the electrodes. In this process the layer of electrically photosensitive material may be sandwiched between two support sheets to form an imaging element. After application of the field and exposure, a visual record of the image pattern is developed on at least one of the two sheets by separation of the sheets. The support sheets may be electrodes. Or electrodes may be directly attached to the back surfaces of the support sheets. Alternatively, one or both of the support sheets may be made of a conductive material. In some embodiments, at least one of the sheets is transparent so as to permit exposure of the imaging layer.

In each of the foregoing processes, the imaging layer of electrically photosensitive material is, or can be rendered, at least partially liquid. The phrase "partially liquid" is used herein to mean that the cohesive forces of the materials forming the layer are sufficiently weak, or weakened, to permit some imagewise migration of the electrically photosensitive material, under the combined influence of exposure to activating electromagnetic radiation and an electric field, in the layer of electrically photosensitive material.

In general, imaging layers which are not at least partially liquid may be rendered at least partially liquid by treatment with, for example, heat, a solvent and/or solvent vapors before, during or after the exposure to an image pattern of electromagnetic radiation and application of an electric field. Good results are obtained if the layer is liquefied subsequent to the exposure and field application steps. In the latter situation, the imaging layer is liquefied in the presence of an electric field and the image is developed according to one of the techniques previously mentioned herein.

The extent to which the electrically photosensitive materials migrate in those imaging layers, which must be liquefied, can be controlled by varying the strength and duration of the electric field, the intensity and duration of the exposure and the time which the imaging layer is exposed to a particular liquefying medium such as heat and/or solvent. For example, if the imaging layer is only slightly liquefied, the electrically photosensitive material will migrate only slightly, thus forming an underdeveloped image record. This image layer, containing the underdeveloped image record, can be stored and developed more fully at a later date. This delayed development can be carried out simply by placing the underdeveloped image layer in an electric field and then liquefying the layer sufficiently to allow the exposed electrically photosensitive material to resume migration. Development of the visual record of the image pattern is then carried out according to one of the above mentioned techniques.

The electrically photosensitive material of this invention in general comprises the Formula I electrically photosensitive polymeric compounds dispersed in an electrically insulating carrier material such as an electrically insulating liquid, or an electrically insulating, liquefiable matrix material, such as a heat and/or solvent liquefiable polymeric material or a thixotropic polymeric material.

Generally, the electrically photosensitive material of this invention will comprise from about 0.05 part to about 2.0 parts of electrically photosensitive compound, including the polymeric compounds of Formula I, for each 10 parts by weight of electrically insulating carrier material.

Useful liquefiable electrically insulating carriers are disclosed in aforementioned U.S. Pat. Nos. 3,520,681; 3,975,195; 4,013,462; 3,707,368; 3,692,516 and 3,756,812. The carrier can comprise an electrically insulating liquid such as decane, paraffin, Sohio Odorless Solvent 3440 (a kerosene fraction marketed by the Standard Oil Company, Ohio), various isoparaffinic hydrocarbon liquids, such as those sold under the trademark Isopar G by Exxon Corporation and having a boiling point in the range of 145° C. to 186° C., various halogenated hydrocarbons such as carbon tetrachloride, trichloromonofluoromethane, and the like, various alkylated aromatic hydrocarbon liquids such as the alkylated benzenes, for example, xylenes, and other alkylated aromatic hydrocarbons such as are described in U.S. Pat. No. 2,899,335. An example of one such useful alkylated aromatic hydrocarbon liquid which is commercially available is Solvesso 100 sold by Exxon Corporation. Solvesso 100 has a boiling point in the range of about 157° C. to about 177° C. and contains 98 percent volume of $C_8$ to $C_{12}$ aromatics. Typically, whether solid or liquid at normal room temperatures, i.e., about 22° C., the electrically insulating carrier used in the present invention has a resistivity greater than about $10^9$ ohm-cm, preferably greater than about $10^{12}$ ohm-cm.

In general, electrically photosensitive material useful in photoelectrophoretic imaging layers and processes according to this invention, comprise particles having an average particle size within the range of from about 0.01 micron to about 20 microns, preferably from about 0.01 to about 5 microns. Generally, these particles are composed of one or more colorants and/or electrically photosensitive compounds, including the compounds of Formula I.

As stated hereinbefore, the electrically photosensitive materials may also contain various nonphotosensitive materials such as electrically insulating polymers, charge control agents, various organic and inorganic fillers, as well as various additional dyes or pigment materials to change or enhance various colorant and physical properties of the electrically photosensitive particle. Such electrically photosensitive materials may also contain other photosensitive materials such as various sensitizing dyes and/or chemical sensitizers to alter or enhance their response characteristics to activating radiation.

The Formula I materials may also be used as colorants and combined with polymers containing organic photoconductive repeating units to form electrically photosensitive composite particles. Useful polymers are disclosed in Item 19014, Volume 190, of the Feb., 1980, issue of *Research Disclosure,* entitled "Composite Electrically Photosensitive Particles." The disclosed polymers have repeating units selected from the classes consisting of triarylamines; p-aminotetraarylmethanes; 4,4'-bis(p-amino)triarylmethanes; 1,1-bis(p-aminoaryl-)isobutanes;1,1-bis(p-aminoaryl)cyclohexanes; N-alkyl-N,N-diarylamines; N,N-dialkyl-N-arylamines and heterocyclic nitrogen compounds having about 4 to 10 carbon atoms.

The Formula I materials may also be combined with other colorants, such as are disclosed in aforementioned *Research Disclosure* to form electrically photosensitive composite particles.

To form the composite particles about 10 to about 80 weight percent of the colorant is dispersed or ground with the dissolved polymer binder in a liquid carrier to submicron particles on a ball mill, Dynomill® (manufactured by Willy A. Bachofen Maschinenfabrik of Basil, Switzerland) or other milling device. The colorant/binder dispersion is added to a solvent in which the binder is insoluble, and the binder precipitates. The particles are isolated by centrifugation, filtration or diafiltration, and added to a carrier solvent containing a charge agent. The mixture is then dispersed.

An alternative method of making a composite particle is to either mill the colorant in the case of a pigment with a charge agent before addition of, or simultaneously with the selected binder, or to add some of the charge control agent after milling with the binder before precipitation.

Charge control agents may be incorporated to improve the uniformity of charge polarity of the electrically photosensitive materials. Charge control agents are typically polymeric materials incorporated in the electrically photosensitive materials by admixture thereof into the carrier. In addition to, and possibly related to, the aforementioned enhancement of uniform charge polarity, the charge control agents often provide more stable suspensions, i.e., suspensions which exhibit substantially less settling out of the dispersed photosensitive particles.

Illustrative charge control agents include those disclosed in U.S. Pat. No. 4,219,614 by Stahly. The polymeric charge control agents disclosed therein comprise a copolymer having at least two different repeating units, (a) one of said units being present in an amount of at least about $0.5\times10^{-4}$ moles/gram of said copolymer and being derived from monomers selected from the group consisting of metal salts of sulfoalkyl acrylates and methacrylates and metal salts of acrylic and methacrylic acids, and (b) one of said repeating units being derived from monomers soluble in the carrier and present in an amount sufficient to render said copolymer soluble in the carrier material.

Examples of such copolymers are poly(vinyltoluene-co-lauryl methacrylate-co-lithium methacrylate-co-methacrylic acid), poly(styrene-co-lauryl methacrylate-co-lithium sulfoethyl methacrylate), poly(vinyltoluene-co-lauryl methacrylate-co-lithium methacrylate), poly(t-butylstyrene-co-lauryl methacrylate-co-lithium methacrylate-co-methacrylic acid) or poly(t-butylstyrene-co-lithium methacrylate).

Various polymeric binder materials such as various natural, semi-synthetic or synthetic resins, may be dispersed or dissolved in the electrically insulating carrier portion of the electrically photosensitive material to serve as a fixing material for the final photoelectrophoretic image. The use of such fixing addenda is well known in the art of liquid electrographic developer compositions so that extended discussion thereof is unnecessary herein.

Imaging elements comprising layers of the electrically photosensitive material of this invention are made according to well-known techniques. The elements may be formed simply by admixing the components of the photosensitive material in an electrically insulating liquid or liquefiable carrier and coating the resulting suspension or dispersion on a support according to well-known coating techniques. The support can be insulating or conductive, depending on the desired use. Useful supports and coating techniques are described throughout the literature of electrophotography and photoelectrophoretic imaging. Hence, extended discussion of the preparation of such elements will not be presented herein.

The utility of the electrically photosensitive materials comprising Formula I compounds in an photoelectrophoretic imaging process will be described in more detail with reference to the accompanying drawing, FIG. 1, which illustrates a typical apparatus for carrying out photoelectrophoretic imaging processes.

FIG. 1 shows a transparent electrode 1 supported by two rubber drive rollers 10 capable of imparting a translating motion via original image 11 to electrode 1 in the direction of the arrow. Electrode 1 may be composed of a layer of optically transparent material, such as glass or an electrically insulating, transparent polymeric support such as polyethylene terephthalate, covered with a thin, optically transparent, conductive layer such as tin oxide, indium oxide, nickel, and the like. Optionally, depending upon the particular type of photoelectrophoretic imaging process desired, the surface of electrode 1 may bear a "dark charge exchange" material, such as a solid solution of an electrically insulating polymer and 2,4,7-trinitro-9-fluorenone as described by Groner in U.S. Pat. No. 3,976,485 issued Aug. 24, 1976 and incorporated herein by reference.

Spaced opposite electrode 1, and in pressure contact therewith, is a second electrode 5, an idler roller which serves as a counter electrode to electrode 1 for producing the electric field used in the exemplified photoelectrophoretic imaging process. Typically, electrode 5 has on the surface thereof a thin, electrically insulating layer 6. Electrode 5 is connected to one side of a power source 15 by switch 7. The opposite side of the power source 15 is connected to electrode 1 so that when an exposure takes place, switch 7 can be closed and an electric field applied to the electrically photosensitive material 4 which is positioned between electrodes 1 and 5. Typically, electrically photosensitive material 4 comprises an electrically insulating carrier material such as described hereinabove.

The photoelectrophoretic imaging material 4 is formed into a layer between electrodes 1 and 5 by applying the material 4 containing a Formula I electrically photosensitive compound to either or both of the surfaces of electrodes 1 and 5 prior to the imaging process or by placing the dispersion between electrodes 1 and 5 during the photoelectrophoretic imaging process.

As shown in FIG. 1, exposure of layer 4 takes place by use of an exposure system consisting of light source 8, an original image 11 to be reproduced, such as a photographic transparency, a lens system 12, and any necessary or desirable radiation filters 13, such as color filters, whereby electrically photosensitive material 4 is irradiated with a pattern of activating radiation corresponding to original image 11. Although the photoelectrophoretic imaging system represented in FIG. 1 shows electrode 1 to be transparent to activating radiation from light source 8, it is possible to irradiate electrically photosensitive material 4 in the nip 21 between electrodes 1 and 5 without either of electrodes 1 or 5 being transparent. In such a system, although not shown in FIG. 1, the exposure source 8 and lens system 12 is arranged so that electrically photosensitive material 4 is exposed in the nip or gap 21 between electrodes 1 and 5.

As shown in FIG. 1, electrode 5 is a roller electrode having a conductive core 14 connected to power source 15. The core is in turn covered with a layer of insulating material 6, for example, baryta-coated paper. Insulating material 6 serves to prevent or at least substantially reduce the capability of electrically photosensitive material 4 to undergo a charge alteration upon interaction with electrode 5. Hence, the term "blocking electrode" may be used, as is conventional in the art of photoelectrophoretic imaging, to refer to electrode 5.

Although electrode 5 is shown as a roller electrode and electrode 1 is shown as essentially a translatable, flat transparent plate electrode in FIG. 1, either or both of these electrodes may assume a variety of different shapes such as a web electrode, rotating drum electrode, opaque plate electrode, and the like, as is well known in the field of photoelectrophoretic imaging. In general, during a photoelectrophoretic imaging process wherein electrically photosensitive material 4 comprises an electrically insulating, liquid carrier, electrodes 1 and 5 are spaced such that they are in pressure contact or very close to one another during the photoelectrophoretic imaging process, e.g., less than 50 microns apart. However, where the electrically photosensitive material is simply disposed, without a liquid carrier, in the gap between electrodes 1 and 5 or comprises a carrier, such as a heat and/or solvent-liquefiable material and coated as a separate layer on electrode 1 and/or 5, these electrodes may be spaced more than 50 microns apart during the imaging process.

The strength of the electric field imposed between electrodes 1 and 5 during the photoelectrophoretic imaging process may vary considerably; however, it has generally been found that optimum image density and resolution are obtained by increasing the field strength to as high a level as possible without causing electrical breakdown of the carrier medium in the electrode gap. For example, when electrically insulating liquids such as isoparaffinic hydrocarbons are used as the carrier in the imaging apparatus of FIG. 1, the applied voltage across electrodes 1 and 5 typically is within the range of from about 100 volts to about 4 kilovolts or higher.

As explained hereinabove, image formation occurs in photoelectrophoretic imaging processes as the result of the combined action of activating radiation and electric field on the electrically photosensitive material disposed between electrodes 1 and 5 in the attached drawing. Typically, for best results, field application and exposure to activating radiation occur concurrently. However, as would be expected, by appropriate selection of various process parameters such as field strength, activating radiation intensity, incorporation of suitable light sensitive addenda in or together with the electrically photosensitive particles formed from the materials of Formula I, e.g., by incorporation of a persistent photoconductive material, and the like, it is possible to alter the timing of the exposure and field application events so that one may use sequential exposure and field application events rather than concurrent field application and exposure events.

When disposed between imaging electrodes 1 and 5 of FIG. 1, electrically photosensitive material 4 exhibits an electrostatic charge polarity, either as a result of triboelectric interaction of the particles or as a result of the particles interacting with the carrier material in which they are dispersed, for example, an electrically insulating liquid, such as occurs in conventional liquid electrographic developing compositions composed of toner particles which acquire a charge upon being dispersed in an electrically insulating carrier liquid.

Image discrimination occurs in photoelectrophoretic imaging processes as a result of the combined application of electric field and activating radiation on the electrically photosensitive material 4 positioned between electrodes 1 and 5 of the apparatus shown in FIG. 1. That is, in a typical imaging operation, upon application of an electric field between electrodes 1 and 5, the particles of charge-bearing, electrically photosensitive material are attracted in the dark to either electrodes 1 or 5, depending upon which of these electrodes has a polarity opposite to that of the original charge polarity acquired by the electrically photosensitive particles. And, upon exposing electrically photosensitive material 4 to activating electromagnetic radiation, it is theorized that there occurs reversal of the charge polarity associated with either the exposed or unexposed particles. In photoelectrophoretic imaging systems wherein electrode 1 bears a conductive surface, the exposed, electrically photosensitive material 4, upon coming into electrical contact with such conductive surface, undergo a reversal of their original charge polarity as a result of the combined application of electric field and activating radiation. Alternatively, in the case of photoimmobilized photoelectrophoretic recording (PIER), wherein the surface of electrode 1 bears a dark charge exchange material as described by Groner in aforementioned U.S. Pat. No. 3,976,485, one obtains reversal of the charge polarity of the unexposed particles, while maintaining the original charge polarity of the exposed electrically photosensitive particles, as these particles come into electrical contact with the dark charge exchange surface of electrode 1. In any case, upon the application of electric field and activating radiation to electrically photosensitive material 4 disposed between electrodes 1 and 5 of the apparatus shown in FIG. 1, one can effectively obtain image discrimination so that an image pattern is formed by the electrically photosensitive particle layer which corresponds to the original pattern of activating radiation. Using the apparatus shown in FIG. 1, one obtains a visible image on the surface of electrode 1 and a complementary image pattern on the surface of electrode 5.

Subsequent to the application of the electric field and exposure to activating radiation, the images which are formed on the surface of electrodes 1 and/or 5 of the apparatus shown in FIG. 1 may be temporarily or permanently fixed to these electrodes or may be transferred to a final image receiving element. Fixing of the final image can be effected by various techniques, for example, by applying a resinous coating over the surface of the image bearing substrate. For example, if electrically photosensitive material 4 includes a liquid carrier between electrodes 1 and 5, one may fix the image or images formed on the surface of electrodes 1 and/or 5 by incorporating a polymeric binder material in the carrier liquid. Many such binders are well known for use in electrophotographic liquid developers. They are known to acquire a charge polarity upon being dispersed in a carrier liquid. Therefore they will, themselves, electrophoretically migrate to the surface of one or the other of the electrodes. Alternatively, a coating of resinous binder (which has been admixed in the carrier liquid), may be formed on the surfaces of electrodes 1 and/or 5 upon evaporation of the liquid carrier.

The electrically photosensitive material of this invention comprisisng Formula I compounds can be used to form monochrome images. Or the material may comprise an admixture of (1) one or more Formula I compounds and/or (2) other electrically photosensitive materials of proper color and photosenstivity and used to form neutral or polychrome images. Many of the electrically photosensitive colorant materials having Formula I have especially useful hues which make them particularly suited for use in polychrome imaging processes which employ a mixture of two or more differently colored electrically photosensitive particles. Preferably, the specific cyan, magenta, and yellow particles selected for use in such a polychrome imaging process are chosen so that their spectral response curves do not appreciably overlap whereby color separation and subtractive multicolor image reproduction can be achieved.

The following examples illustrate the utility of the Formula I materials in photoelectrophoretic imaging processes.

EXAMPLES 1–11

Imaging Apparatus

An imaging apparatus was used in each of the following examples to carry out the photoelectrophoretic imaging process described herein. This apparatus was a device of the type illustrated in FIG. 1. In this apparatus, a translating film base having a conductive coating of 0.1 optical density cermet (Cr.SiO) served as electrode 1 and was in pressure contact with a 10 centimeter diameter aluminum roller 14 covered with dielectric paper coated with poly(vinyl butyral) resin which served as electrode 5. Plate 1 was supported by two 2.8 cm. diameter rubber drive rollers 10 positioned beneath film plate 1 such that a 2.5 cm. separation, existed to allow exposure of electrically photosensitive particles 4 to activating radiation. The original transparency 11 to be reproduced was taped to the backside of film plate 1.

The original transparency to be reproduced consisted of adjacent strips of clear, red, green and blue filters. The light source consisted of a Kodak Carousel Projector with a tungsten lamp. The light was modulated with a 0.3 neutral density step tablet. The residence time in the action or exposure zone was 10 milliseconds. The voltage between the electrode 5 and film plate 1 was about 2 kv. Film plate 1 was of negative polarity in the case where electrically photosensitive material of layer 4 carried a positive electrostatic charge, and film plate 1 was positive in the case where electrically photosensitive electrostatically charged particles were negatively charged. The translational speed of film plate 1 was about 25 cm. per second. In the following examples, image formation occurs on the surfaces of film plate 1 and electrode 5 after simultaneous application of light exposure and electric field to electrically photosensitive layer 4 formed from the dispersion of electrically photosensitive material of Formula I in a liquid carrier. The liquid imaging dispersion was placed in nip 21 between the electrodes 1 and 5. If the material being evaluated for use in layer 4 possessed a useful level of electrical photosensitivity, one obtained a negative-appearing image reproduction of original 11 on electrode 5 and a positive image on electrode 1.

Imaging Dispersion Preparation

Imaging dispersions were prepared to evaluate each of the materials in Table I. The dispersions were prepared by first making a stock solution of the following components. The stock solution was prepared simply by combining the components.

Isopar G: 2.2 g
Solvesso 100:1.3 g
Piccotex 100:1.4 g
PVT: 0.1 g

PVT is poly(vinyltoluene-co-lauryl methacrylate-co-lithium methacrylate-co-methacrylic acid) 56/40/3.6/0.4.

Piccotex 100 is a mixture of styrene-vinyl toluene copolymers available from Pennsylvania Industrial Chemical Corp.

Isopar G is an isoparaffinic aliphatic hydrocarbon from Exxon Corporation.

Solvesso comprises 98% by volume of $C_8$–$C_{12}$ aromatics and is available from Exxon Corporation.

A 5 g. aliquot of the stock solution was combined in a closed container with 0.045 g. of a Table I polymer to be tested and 12 g. of Pioneer 440 stainless steel balls. The mixture was then milled for three hours on a paint shaker.

Polymers 1, 2, 7, 8, 16, 19, 20, 21, 22 and 23 in Table I were tested according to the above procedures. Each polymer tested was found to be electrically photosensitive as evidenced by obtaining a negative appearing image of the original on one electrode and a positive image on the other electrode.

EXAMPLE 12

An electrically photosensitive composite particle dispersion was prepared by ball milling the pigment, Cyan Blue GTNF (copper phthalocyanine available from American Cyanamid) in a $CH_2Cl_2$ solution of Polymer 8 of Table I with ⅛" stainless steel balls for five days. The pigment to polymer ratio was 1/0.5 by weight. The latter dispersion was poured into Isopar G. A precipitate formed which was isolated by centrifugation. The precipitate, consisting of electrically photosensitive composite particles, was redispersed with PVT in Isopar G at a pigment to PVT ratio of 1/0.5 by weight.

A control dispersion was prepared as above except Polymer 8 was not included. Thus, Cyan Blue GTNF was the only photosensitive material present in the control dispersion.

The relative sensitivity of each dispersion to a red filtered white light exposure was measured. The relative sensitivity measurements reported in this and the following examples are relative reciprocal electrical photosensitivity measurements. The relative reciprocal electrical photosensitivity measures the speed of a given electrically photosensitive element relative to other elements typically within the same test group of elements. The relative reciprocal sensitivity values are not absolute senstivity values. However, relative reciprocal sensitivity values are related to absolute sensitivity values. The relative reciprocal electrical photosensitivity is a dimensionless number and is obtained simply by arbitrarily assigning a value, Ro, to one particular absolute reciprocal sensitivity of one control element. The relative reciprocal sensitivity Rn, of any other photoconductive element, n, relative to this value, Ro, may then be calcuted as follows: $Rn=(A_n)(Ro/Ao)$ wherein An is the absolute reciprocal electrical photosensitivity (in $cm^2$/ergs.) of n, Ro is the sensitivity value arbitrarily assigned to the control element, and Ao is the absolute reciprocal electrical photosensitivity (measured in $cm^2$/ergs.) of the control element. The following results were obtained:

TABLE II

| | Relative Sensitivity (at 0.1 above $D_{min}$) | |
|---|---|---|
| | Positive Image | Negative Image |
| Control | 100* | 100* |
| Composite Particle | 640 | 580 |

*Arbitrarily assigned a value of 100

This example shows that the sensitivity of the composite particle, which included a Table I polymer, is 6.4 times greater than the control for the positive image and 5.8 times greater than the control for the negative image.

EXAMPLE 13

Another electrically photosensitive composite particle dispersion was prepared as in Example 12 except the composite particles contained Polymer 8 of Table I and the colorant was mixed quinacridone. A control dispersion was also prepared as in Example 12 with mixed quinacridone as the only electrically photosensitive material present in the dispersion. The relative sensitivities to green filtered light of the dispersions were measured as in Example 12, with the following results:

TABLE III

| | Relative Sensitivity (at 0.1 above $D_{min}$) | |
|---|---|---|
| | Positive Image | Negative Image |
| Control | 100* | 100* |
| Composite Particle | 393 | 343 |

*Arbitrarily assigned a value of 100

This example shows, as in Table II, Example 12, that the composite particle dispersions have significantly higher sensitivity compared to the electrically photosensitive pigment of mixed quinacridone alone.

The invention has been described in detail with particular reference to certain preferred embodiments thereof, but it will be understood that variations and modifications can be effected within the spirit and scope of the invention.

We claim:

1. A photoelectrophoretic image comprising an electrically photosensitive material containing an electrically photosensitive polymeric compound of the structure:

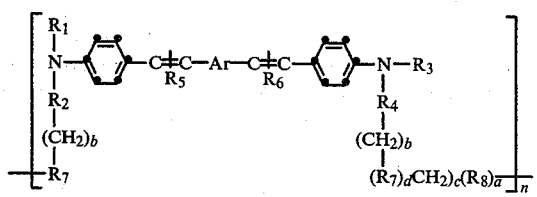

I wherein:

$R_1$ and $R_3$, which are the same or different, represent a substituted or unsubstituted alkyl group having from 1 to 18 carbon atoms or a substituted or unsubstituted aryl group;

$R_2$ and $R_4$, which are the same or different, represent a substituted or unsubstituted alkylene group having from 1 to 10 carbon atoms or a substituted or unsubstituted arylene group;

$R_5$ and $R_6$, which are the same or different, represent hydrogen or an electron withdrawing group;

$R_7$ and $R_8$, which are always different, represent oxy, imino, thio, carbonyloxy, oxycarbonyl, iminocarbonyl, carbonyldioxy, ureylene, carbonyloxycarbonyl, sulfonyl, iminosulfonyl, iminocarbonyloxy, pipiridine-1,4-diyl and 1-carbonylpipiridine-1,4-diyl;

Ar is an unsubstituted or a substituted arylene group wherein said substitutent is an electron donating group or an electron withdrawing group;

a and d are 0 or 1;

b and c are whole numbers of from 1 to 25; and n is a whole number having a value of at least 2.

2. An electrically photosensitive material comprising a liquid or partially liquefiable electrically insulating carrier and particles dispersed in said carrier comprising an electrically photosensitive polymeric compound of the structure:

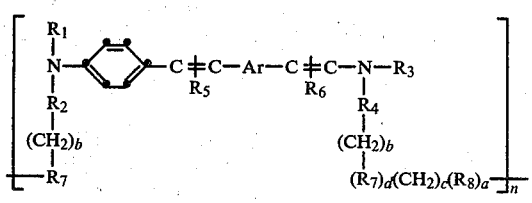

I wherein:

$R_1$ and $R_3$, which are the same or different, represent a substituted or unsubstituted alkyl group having from 1 to 18 carbon atoms or a substituted or unsubstituted aryl group;

$R_2$ and $R_4$, which are the same or different, represent a substituted or unsubstituted alkylene group having from 1 to 10 carbon atoms or a substituted or unsubstituted arylene group;

$R_5$ and $R_6$, which are the same or different, represent hydrogen or an electron withdrawing group;

$R_7$ and $R_8$, which are always different, represent oxy, imino, thio, carbonyloxy, oxycarbonyl, iminocarbonyl, carbonyldioxy, ureylene, carbonyloxycarbonyl, sulfonyl, iminosulfonyl, iminocarbonyloxy, piperidine-1,4-diyl and 1-carbonylpiperidine-1,4-diyl;

Ar is an unsubstituted or a substituted arylene group wherein said substituent is an electron donating group or an electron withdrawing group;

a and d are 0 or 1;

b and c are whole numbers of from 1 to 25; and n is a whole number having a value of at least 2.

3. A material as in claim 2, wherein said electrically photosensitive polymeric compound has the structure:

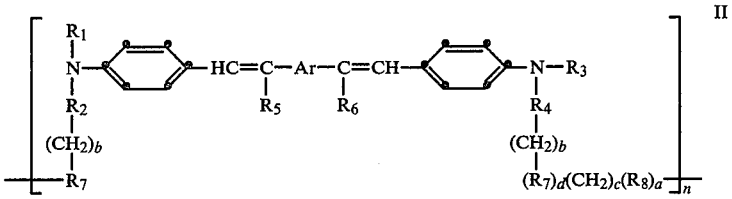

II wherein:

$R_1$ and $R_3$, which are the same or different, represent a substituted or unsubstituted alkyl group having from 1 to 18 carbon atoms or a substituted or unsubstituted aryl group;

$R_2$ and $R_4$, which are the same or different, represent an alkylene group having from 2 to 10 carbon atoms or a substituted or unsubstituted arylene group;

$R_5$ and $R_6$, which are the same or different, represent hydrogen or an electron withdrawing group selected from the group consisting of —CN, —$CF_3$, —$NO_2$, —$CO_2R_9$, —$SO_2F$ wherein $R_9$ is an alkyl group having from 1 to 12 carbon atoms;

$R_7$ and $R_8$, which are always different, represent oxy, imino, thio, oxycarbonyl, iminocarbonyl, carbonyldioxy, ureylene, carbonyloxycarbonyl, sulfonyl, iminosulfonyl, iminocarbonyloxy, piperidine-1,4-diyl and 1-carbonylpiperidin-1,4-diyl;

Ar represents a substituted or unsubstituted phenylene, naphthylene or anthrylene wherein said substituent is selected from the group consisting of hydrogen, —CN, —$CO_2R_9$, —$OR_9$, —$CF_3$, —$NO_2$, —Cl, —$SR_9$ and —$R_9$;

a and d are 0 to 1;

b and c are whole numbers of from 1 to 25; and n is a whole number having a value of from about 2 to about 150.

4. A material as in claims 2 or 3 which also includes a charge control agent.

5. A material as in claims 2 or 3 which contains electrically photosensitive composite particles comprising an electrically photosensitive polymeric compound having a structure according to Formulas I or II.

6. A photoelectrophoretic image recording method comprising the steps of:

(a) subjecting an imaging element comprising a layer of an electrically photosensitive material to an electrical field;

(b) exposing said element to an image pattern of electromagnetic radiation to which said layer is photosensitive to form a record of the image pattern of electromagnetic radiation in said layer;

wherein said layer comprises a liquid or partially liquefiable electrically insulating carrier and particles dispersed in said carrier comprising an electrically photosensitive compound having the structure:

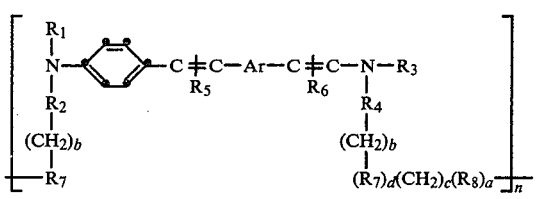

I wherein:

$R_1$ and $R_3$, which are the same or different, represent a substituted or unsubstituted alkyl group having from 1 to 18 carbon atoms or a substituted or unsubstituted aryl group;

$R_2$ and $R_4$, which are the same or different, represent a substituted or unsubstituted alkylene group having from 1 to 10 carbon atoms or a substituted or unsubstituted arylene group;

$R_5$ and $R_6$, which are the same or different, represent hydrogen or an electron withdrawing group;

$R_7$ and $R_8$, which are always different, represent oxy, imino, thio, carbonyloxy, oxycarbonyl, iminocarbonyl, carbonyldioxy, ureylene, carbonyloxycarbonyl, sulfonyl, iminosulfonyl, iminocarbonyloxy, piperidine-1,4-diyl and 1-carbonylpiperidine-1,4-diyl;

Ar is an unsubstituted or a substituted arylene group wherein said substituent is an electron donating group or an electron withdrawing group;

a and d are 0 or 1;

b and c are whole numbers of from 1 to 25; and n is a whole number having a value of at least 2.

7. A method as in claim 6, further comprising the steps of:

(a) placing said element between two electrodes during the exposure and application of the electric field and then (b) separating the electrodes thereby forming a visual record of the image pattern of electromagnetic radiation on at least one of the electrodes.

8. A method as in claim 6, further comprising the steps of:

(a) placing said layer between two support sheets to form the imaging element;

(b) positioning the element between two electrodes during the exposure and application of the electric field; and (c) separating the two support sheets thereby forming a visual record of the image pattern of electromagnetic record on the support sheets.

9. A method as in claim 6, further comprising the step of developing a visual record of the image pattern of electromagnetic radiation by removing the exposed or unexposed portion of said layer.

10. A method as in claims 6, 7 or 8 wherein said electrically photosensitive polymeric compound has the structure:

I

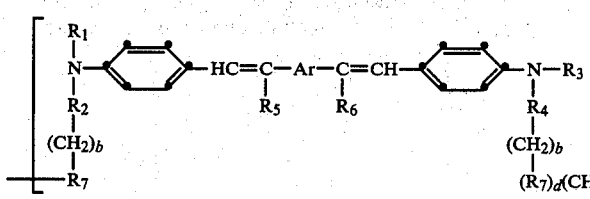

wherein:

$R_1$ and $R_3$, which are the same or different, represent a substituted or unsubstituted alkyl group having from 1 to 18 carbon atoms or a substituted or unsubstituted aryl group;

$R_2$ and $R_4$, which are the same or different, represent an alkylene group having from 2 to 10 carbon atoms or a substituted or unsubstituted arylene group;

$R_5$ and $R_6$, which are the same or different, represent hydrogen or an electron withdrawing group selected from the group consisting of —CN, —$CF_3$, —$NO_2$, —$CO_2R_9$, —$SO_2F$ wherein $R_9$ is an alkyl group having from 1 to 12 carbon atoms;

$R_7$ and $R_8$, which are always different, represent oxy, imino, thio, oxycarbonyl, iminocarbonyl, carbonyldioxy, ureylene, carbonyloxycarbonyl, sulfonyl, iminosulfonyl, iminocarbonyloxy, piperidine-1,4-diyl and 1-carbonylpiperidine-1,4-diyl;

Ar represents a substituted or unsubstituted phenylene, naphthylene or anthrylene wherein said substituent is selected from the group consisting of hydrogen, —CN, —$CO_2R_9$, —$OR_9$, —$CF_3$, —$NO_2$, —Cl, —$SR_9$ and —$R_9$;

a and d are 0 to 1;

b and c are whole numbers of from 1 to 25; and n is a whole number having a value of from about 2 to about 150.

11. An imaging element comprising a layer of an electrically photosensitive material which comprises a liquid or partially liquefiable electrically insulating carrier and particles dispersed in said carrier comprising an electrically photosensitive polymeric compound of the structure:

II

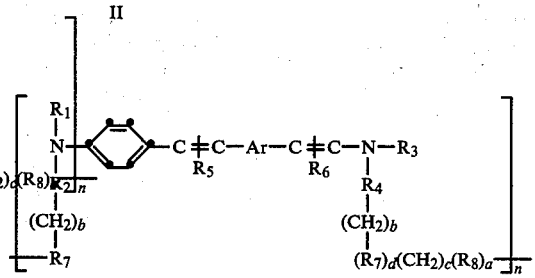

$R_1$ and $R_3$, which are the same or different, represent a substituted or unsubstituted alkyl group having from 1 to 18 carbon atoms or a substituted or unsubstituted aryl group;

$R_2$ and $R_4$, which are the same or different, represent a substituted or unsubstituted alkylene group having from 1 to 10 carbon atoms or a substituted or unsubstituted arylene group;

$R_5$ and $R_6$, which are the same or different, represent hydrogen or an electron withdrawing group;

$R_7$ and $R_8$, which are always different, represent oxy, imino, thio, carbonyloxy, oxycarbonyl, iminocarbonyl, carbonyldioxy, ureylene, carbonyloxycarbonyl, sulfonyl, iminosulfonyl, iminocarbonyloxy, piperidine-1,4-diyl and 1-carbonylpiperidine-1,4-diyl;

Ar is an unsubstituted or a substituted arylene group wherein said substituent is an electron donating group or an electron withdrawing group;

a and d are 0 or 1;

b and c are whole numbers of from 1 to 25; and n is a whole number having a value of at least 2.

12. An element as in claim 11 wherein the layer is carried on a support.

13. An element as in claim 11 wherein the layer is situated between two support sheets.

14. An element as in claim 13 wherein at least one support sheet is transparent to activating electromagnetic radiation.

15. An element as in claims 13 and 14, wherein said electrically photosensitive polymeric compound has the structure:

II

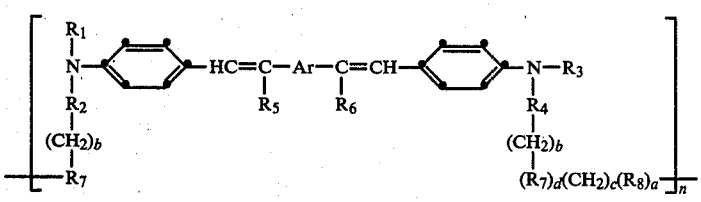

wherein:

$R_1$ and $R_3$, which are the same or different, represent a substituted or unsubstituted alkyl group having from 1 to 18 carbon atoms or a substituted or unsubstituted aryl group;

$R_2$ and $R_4$, which are the same or different, represent an alkylene group having from 2 to 10 carbon atoms or a substituted or unsubstituted arylene group;

$R_5$ and $R_6$, which are the same or different, represent hydrogen or an electron withdrawing group selected from the group consisting of —CN, —$CF_3$, —$NO_2$, —$CO_2R_9$, —$SO_2F$ wherein $R_9$ is an alkyl group having from 1 to 12 carbon atoms;

$R_7$ and $R_8$, which are always different, represent oxy, imino, thio, oxycarbonyl, iminocarbonyl, carbonyldioxy, ureylene, carbonyloxycarbonyl, sulfonyl, iminosulfonyl, iminocarbonyloxy, piperidine-1,4-diyl and 1-carbonylpiperidine-1,4-diyl;

Ar represents a substituted or unsubstituted phenylene, naphthylene or anthrylene wherein said substituent is selected from the group consisting of hydrogen, —CN, —$CO_2R_9$, —$OR_9$, —$CF_3$, —$NO_2$, —Cl, —$SR_9$ and —$R_9$;

a and d are 0 to 1;

b and c are whole numbers of from 1 to 25; and n is a whole number having a value of from about 2 to about 150.

* * * * *

UNITED STATES PATENT AND TRADEMARK OFFICE

CERTIFICATE OF CORRECTION

PATENT NO. : 4,331,751 Page 1 of 2

DATED : May 25, 1982

INVENTOR(S) : Isaacson et al

It is certified that error appears in the above-identified patent and that said Letters Patent are hereby corrected as shown below:

Column 19, line 34, "comprisisng" should read --comprising--; line 38, "photosenstivity" should read --photosensitivity--. Columns 25-26, lines 8-19, the structures from Claims 10 and 11 are overlapped and indecipherable:

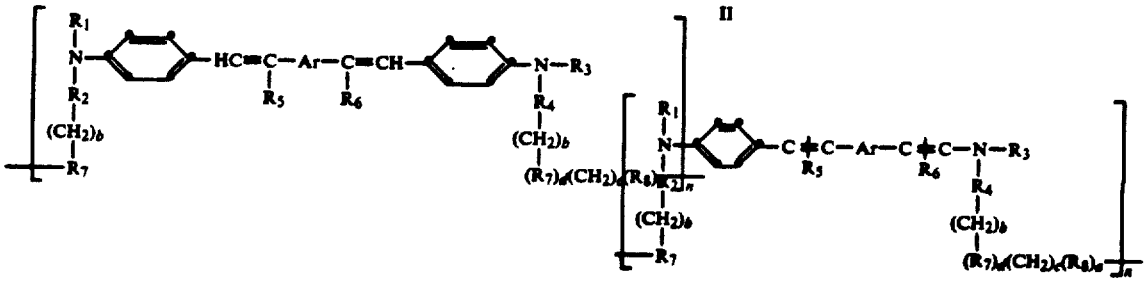

and should be set forth as follows:

UNITED STATES PATENT AND TRADEMARK OFFICE

CERTIFICATE OF CORRECTION

PATENT NO. : 4,331,751 Page 2 of 2

DATED : May 25, 1982

INVENTOR(S) : Isaacson et al

It is certified that error appears in the above-identified patent and that said Letters Patent are hereby corrected as shown below:

Column 25, claim 10, the formula should read:

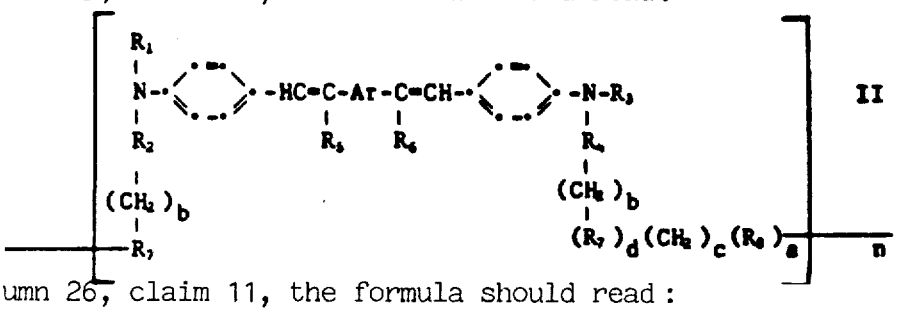

II

Column 26, claim 11, the formula should read:

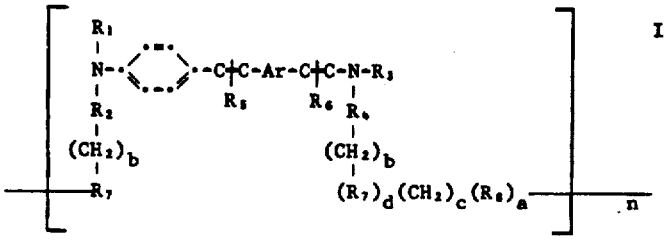

I wherein:

Signed and Sealed this

*Fifteenth* Day of *November 1983*

[SEAL]

*Attest:*

GERALD J. MOSSINGHOFF

*Attesting Officer*

*Commissioner of Patents and Trademarks*